US009849463B2

(12) United States Patent
Peczalski et al.

(10) Patent No.: US 9,849,463 B2
(45) Date of Patent: Dec. 26, 2017

(54) ELECTRIC FIELD ENHANCED SMALL PARTICLE FILTER

(71) Applicant: Honeywell International Inc., Morris Plains, NJ (US)

(72) Inventors: Andy Peczalski, Eden Prairie, MN (US); Brian Keith Olmsted, Richfield, MN (US)

(73) Assignee: Honeywell International Inc., Morris Plains, NJ (US)

( * ) Notice: Subject to any disclaimer, the term of this patent is extended or adjusted under 35 U.S.C. 154(b) by 98 days.

(21) Appl. No.: 14/938,262

(22) Filed: Nov. 11, 2015

(65) Prior Publication Data

US 2016/0175850 A1 Jun. 23, 2016

Related U.S. Application Data

(60) Provisional application No. 62/096,376, filed on Dec. 23, 2014.

(51) Int. Cl.

| | |
|---|---|
| ***B03C 3/47*** | (2006.01) |
| ***B03C 3/014*** | (2006.01) |
| ***B03C 3/155*** | (2006.01) |
| ***B03C 3/60*** | (2006.01) |

(52) U.S. Cl.

CPC ..... *B03C 3/47* (2013.01); *B03C 3/014* (2013.01); *B03C 3/155* (2013.01); *B03C 3/60* (2013.01)

(58) Field of Classification Search

CPC combination set(s) only.
See application file for complete search history.

(56) References Cited

U.S. PATENT DOCUMENTS 4,477,268 A * 10/1984 Kalt ..... B03C 3/60 96/99
4,772,297 A * 9/1988 Anzai ..... B03C 3/155 96/19
5,055,118 A * 10/1991 Nagoshi ..... B03C 3/60 96/77
5,108,470 A * 4/1992 Pick ..... B03C 3/155 96/58
5,474,600 A * 12/1995 Volodina ..... A61L 9/22 96/223
5,573,577 A * 11/1996 Joannou ..... B03C 3/155 96/66
5,807,425 A * 9/1998 Gibbs ..... B03C 3/155 96/66
5,846,302 A * 12/1998 Putro ..... B03C 3/155 96/66
5,993,521 A * 11/1999 Loreth ..... B03C 3/12 96/69
6,129,951 A * 10/2000 Ward-Close ..... C23C 14/562 118/724

(Continued)

OTHER PUBLICATIONS

Choi, Dongwhi, et al., "Spontaneous electrical charging of droplets by conventional pipetting", *Scientific Reports*, 3, Article No. 2037, (2013), 1-7.

*Primary Examiner* — Duane Smith
*Assistant Examiner* — Sonji Turner
(74) *Attorney, Agent, or Firm* — Schwegman Lundberg & Woessner, P.A.

(57) ABSTRACT

A device and method include ionizing particles to be captured, creating electric fields to polarize mats of filter material, and trapping the ionized particles in the polarized mats.

13 Claims, 3 Drawing Sheets

(56) References Cited

U.S. PATENT DOCUMENTS

| | | | | |
|---|---|---|---|---|
| 6,764,533 | B2 * | 7/2004 | Lobiondo, Jr. | B03C 3/155 55/493 |
| 7,112,238 | B2 * | 9/2006 | Joannou | B03C 3/60 96/66 |
| 7,258,729 | B1 * | 8/2007 | Barsimanto | B03C 3/09 96/226 |
| 8,080,094 | B2 * | 12/2011 | Vanderginst | B03C 3/09 96/66 |
| 8,889,079 | B2 * | 11/2014 | Zahedi | B01D 53/323 422/171 |
| 9,040,008 | B2 * | 5/2015 | Zahedi | B01D 53/323 423/245.1 |
| 2008/0190772 | A1 * | 8/2008 | Greist | B01D 46/0032 204/572 |
| 2015/0021796 | A1 | 1/2015 | Peczalski et al. | |

* cited by examiner

ELECTRIC FIELD ENHANCED SMALL PARTICLE FILTER

RELATED APPLICATION

This application claims priority U.S. Provisional Application Ser. No. 62/096,376 (entitled Electric Field Enhanced Small Particle Filter, filed Dec. 23, 2014) which is incorporated herein by reference.

BACKGROUND

Air filtering is performed in residential and commercial buildings and in many industrial applications. The aim is to capture as many small particles as possible e.g. minimum efficiency reporting value of 12-13 with very low cost e.g. $10 disposable filtering media. For residential applications a thin filter e.g. 1" is desired with very small pressure drop e.g. 0.1 inch of water column.

SUMMARY

A device and method include ionizing particles to be captured, creating electric fields to polarize mats of filter material such that the ionized particles are trapped in the polarized mats.

A method includes ionizing particles to be captured, creating electric fields to polarize mats of filter material, and trapping the ionized particles in the polarized mats.

A filter includes multiple mats of conducting filter material, multiple mats of non-conducting filter material, each non-conducting filter material mat disposed between adjacent mats of conducting material, and electrodes coupled to the mats of conducting filter material to create an electric field between successive mats of conducting material to enhance filtering of ionized particles in fluid flowing through the filter.

DETAILED DESCRIPTION

In the following description, reference is made to the accompanying drawings that form a part hereof, and in which is shown by way of illustration specific embodiments which may be practiced. These embodiments are described in sufficient detail to enable those skilled in the art to practice the invention, and it is to be understood that other embodiments may be utilized and that structural, logical and electrical changes may be made without departing from the scope of the present invention. The following description of example embodiments is, therefore, not to be taken in a limited sense, and the scope of the present invention is defined by the appended claims.

Small particle capture by a filter is enhanced via use of high electric fields to ionize air and to polarize filtering media. Low cost may be achieved by using conducting fibers in non-woven or woven multilayer mats. The high electric fields for corona ionization may be achieved by using very thin fibers e.g. 1-5 microns and high electric voltage for example 10 kV. Further ways to achieve ionization include generating many very small droplets of water. The high fields may also be used to polarize non-conducting layers between closely spaced conducting layers. The ionized particles are attracted to the charged fibers in the media. Because of high capture efficiency the fibers in the media may be less dense and therefore result in lower pressure drop across the media. Another way to increase capture efficiency is to slow down the flow of charged particles by applying the opposite voltage polarity than the charged particle has. For example if the corona ionization has positive sign the negative voltage on a subsequent conductive layer could repulse and therefore slow down the particles. If the applied voltage is very high e.g. 14 kV and the distance between electrodes is small e.g. 3 mm the very small e.g. 10 nm, particles that have a single charge could be stopped or their flow could be even reversed for air velocity of several msec. The slowing or reversing the movement of the particles increases their dwelling time in the filtering media and therefore increases probability of such particles being captured by the filtering fibers. In the case of reversing the particle movement direction an alternating current (AC) voltage with frequency of order of 1 kHz could be applied to create multiple passes of particles within the media that would further increase capture probability.

Figure 1:
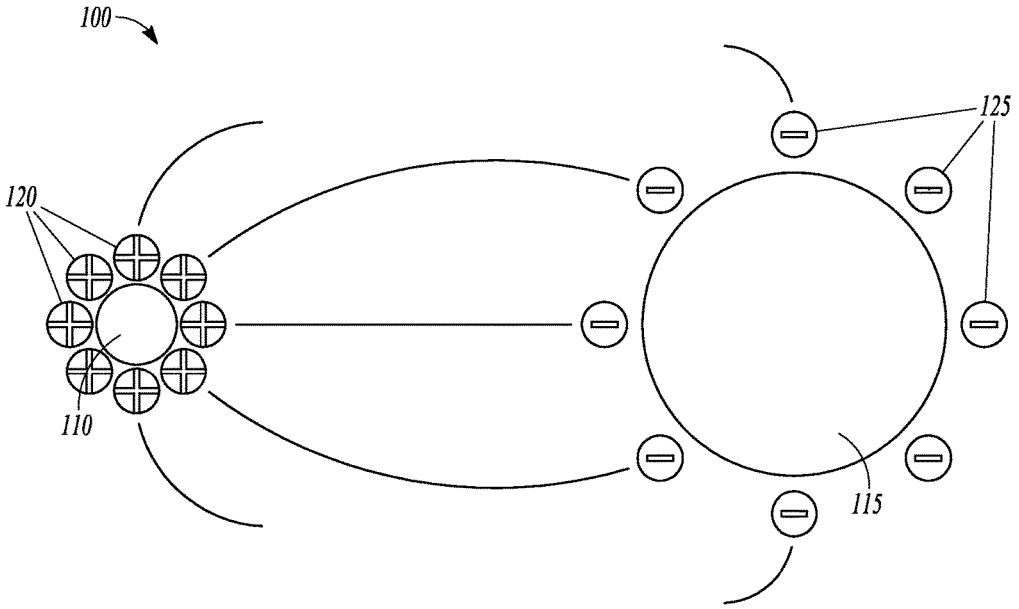
FIG. 1 is a block cross section representation of anode and cathode fibers for forming woven filter elements according to an example embodiment.

In one embodiment illustrated in cross section generally at 100 in FIG. 1, fibers comprise anode and cathode electrodes 110 and 115 respectively. The diameters of the anode and cathode electrodes may be chosen to accomplish controlling the surface charge density accumulating on their respective surfaces. Fiber mats formed of such fibers are positioned in a fashion so that the positive charge density on the smaller fibers comprising the anode 110, indicated by plus signs in a circle at 120, becomes high enough to initiate dielectric breakdown in air, while the negative charge density on the larger diameter fibers comprising the cathode 115, indicated by minus signs in a circle at 125, remains small, to prevent ozone creation. The diameter of the positively charged fibers 110 may be made much smaller than the diameter of negatively charged fibers 115 to facilitate creation of the higher positive charge density compared to the negative charge density, thus maximizing the degree of charge imparted to particulates while not generating noxious ozone gas.

As the particles are accumulated on the fibers, a capacitance between the electrodes changes. Thus the end of filter life (filter fully loaded with dust) may be sensed by capacitive measurements. Filter elements may comprise alternating conductive and nonconductive fibers woven together, forming mats. A charged face of a mat allows every fiber to generate an "amplified" electric field. An upstream filter element may have a very small fiber diameter with close proximity to a grounded frame (to maximize the electric field strength) such that corona discharge is induced, ionizing small particles in the air flow. A first mat captures negatively charged particles; a second mat captures positively charged particles and so on. Each filter element may be thin (e.g. 1 mm) to maximize the field strength across the nonconductive filter element. Insulating filter elements are thin (e.g. 2 mm) and act as a particulate filter, but also help generate a large electric field between the conductive filter elements.

Figure 2:
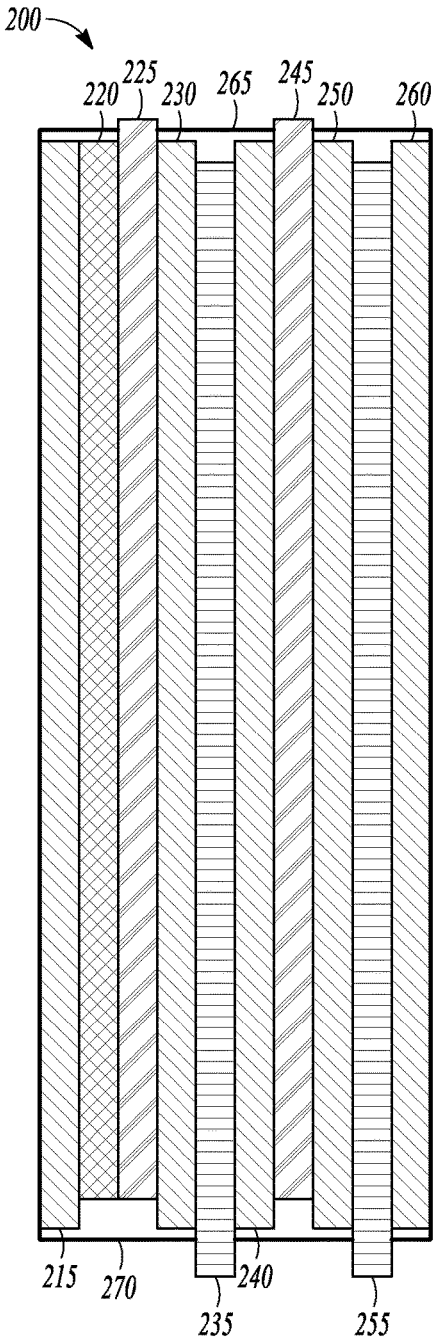
FIG. 2 is a block cross section representation of a multiple layer filter having conductive and insulating layers according to an example embodiment.

FIG. 2 is a cross section of a filter 200 formed of multiple fiber woven mats, also referred to as filter elements. In one embodiment, the filter 200 is designed to accommodate fluid flow, such as airflow that carries particles through the filter elements of the filter 200 in a direction from front to back as indicated by an arrow 210. The filter elements are described in sequence, starting with the furthest upstream filter element 215, referred to as a front element designed to catch larger particles, such as particles having size (at least one dimension) of greater than 4 μm. The front element 215 may be an insulating filter element, and is followed by a fine filter element 220 and a conductive filter element 225. Conductive filter element 225 is followed by an insulating filter element 230 and another conductive filter element 235, insulating element 240, conductive element 245, insulating element 250, conductive element 255 and insulating element 260. In one embodiment, the filter elements comprise alternating conductive and nonconductive fibers. The conductive filter elements are charged alternately with relative positive and negative voltages. Filter elements 225 and 245 may be positively charged in one embodiment with filter elements 235 and 255 being negatively charged. The charges in one example embodiment are approximately +10000V and −10000V respectively.

The charged face of the mat allows every fiber to generate an "amplified" electric field. Upstream filter elements may have a very small fiber diameter with close proximity to the grounded frame (to maximize the electric field strength) such that corona discharge is induced, ionizing small particles in the air flow 210.

The first conductive mat 225 captures negatively charged particles, the second conductive mat 235 captures positively charged particles and so on. While four conductive mats are shown in filter 200, two may be used in some embodiments, and more than four may be used in further embodiments. Cost may be lowered by using fewer filter elements and a larger potential on each face to offset thicker insulating filter elements, Each filter element may be fairly thin, such as 1 mm for example, to maximize the field strength between across the nonconductive filter element. Insulating filter elements are thin, such as approximately 2 mm, and act as a particulate filter, but also help generate a large electric field between the conductive filter elements. The charged mats operate as active electrostatic filters to capture particles independent of particle size while minimizing pressure drop across the filter assembly.

In one embodiment, filter element 220 is a fine fiber single layer of 1-2 um diameter for corona discharge to increase the electric charge on the particles.

In one embodiment, the conductive filter elements may comprise an isolating fiber with both sides coated with a conductive material. Multiple composite nonwoven materials can be fabricated with one fiber made of insulating polymer and another with a conducting polymer e.g. polyaniline, polyethylenedioxythiophene (PEDOT), or polyacetylene. Alternate materials, not including polymer fibers and fiber coatings, could also include carbon-enhanced glass rovings, fibers submitted to an etching and volumetric backfill with a conductive material, such as aluminum salt fillers, or other carbon-based fillers.

A multi-card process may be used to form filter elements in one embodiment with a multi-forming box air-laid process, a multi-material spunbond process, and a combination of various bonding processes.

In one embodiment, the surface fibers may be treated with a conductive layer e.g. electrode-less plating, carbonization to create 0.5 mm conductive layer. The fine fiber layer may be made of metal or metalized (e.g. Ag, Zn) fiber.

The filter panels may be assembled together by clamping two panels together with electrodes on alternating sides. The whole assembly may be further stabilized with ground metal grids 265 and 270 on both ends.

In further embodiments, the electric field and voltage applied may be modified. The stronger the electric field, the larger the capturing action. Therefore, the individual nonconductive layers may be formed as thin as practically possible. The thin nonconductive layers cost more money to assembly and may be subject to electric breakdown. It may also be desired to apply as high a voltage as possible. For example, a 10 kV power supply is feasible and comparatively safe since the amount of current is very small.

In one embodiment, an alternating voltage may be applied to the conducting filter elements. The alternating voltage, if it creates an electric field that is strong enough, will cause the charges particles to slow down or even change the movement direction and have more than one pass through the nonconducting filter elements. For example if 10 nm particle mobility in the air is $2.1e^{-6}$ m*m/sec/V and 14 kV is applied across a 3 mm nonconductive filter element, the particle would achieve velocity of 10 m/sec due to the electric field. Thus at the air flow rate of 5 msec the 10 nm particle flow direction may be reversed. An AC voltage with frequency of about 1 kHz would keep the particle travelling back and forth in the filter element until it is captured. This mechanism may not work for larger particles, such as particles of 100 nm or larger, because their mobility in the air is much lower e.g. $2.7e^{-8}$ m*m/sec/V. Such larger particles are more easily captured in one pass through a filter element. By using the AC voltage across conductive fiber woven filter elements, the capture probability would be significantly increased for the smallest particles that are the hardest to capture by the passive filter.

In one embodiment, ionization of the particles may be performed by use of a micro nozzle spraying humidifier 275 placed upstream from the filter 200 within distance of 1-2 feet so the ions 280 have small chance to recombine before reaching filter 200. The humidifier 275 may include 585 nozzles continuously spraying 1 cup of water per day at 113 kHz to produce: $0.2\text{-}2^{8}$ droplets/$m^3$ and $0.26\text{-}2.6^{11}$ charges/$m^3$. In further embodiments, spontaneous electrical charging of droplets may be obtained by conventional pipetting. In one embodiment, filter 200 operates to capture particles in an environment having an average indoor particle (6 nm–3 μm) count (Vermont) $6^{9}$ particles/$m^3$.

In one embodiment filter element 225 comprises an initial charged layer maximizing a positive charge density to induce an ionizing plasma (Corona Discharge) for charging all incoming particles. Negative charge density may be minimized to prevent negatively charged ionization (ozone production) while catching charged particles. Minimization of negative charge density may be obtained as described above by making the fibers that will be negatively charged with a larger diameter than the fiber in filter elements that will be positively charged. Alternating subsequent positive and negative charge sources may be added for catching additional particles of either charge. Additional filter elements are insulating and operate on direct impingement capturing that may be enhanced by the polarizing effect.

Figure 3:
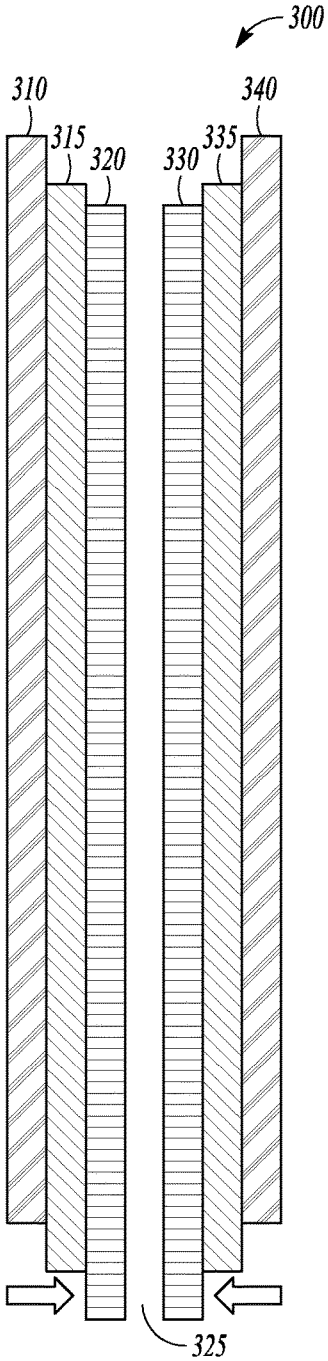
FIG. 3 is a block cross section representation of an alternative multiple layer filter having conductive and insulating layers according to an example embodiment.

FIG. 3 is a cross section of a filter 300 having fewer filter elements. In one embodiment, the cost of filter 300 is lower, and a larger potential on each face is used to offset thicker insulating filter elements. Filter element 300 has a first conducting element 310 followed by an insulating element 315, conducting element 320, a space 325 used as an insulating element, a conducting element 330, insulating element 335 and conducting element 340. Thus, fewer layers overall may be used in filter 300 as compared to filter 200.

Figure 4:
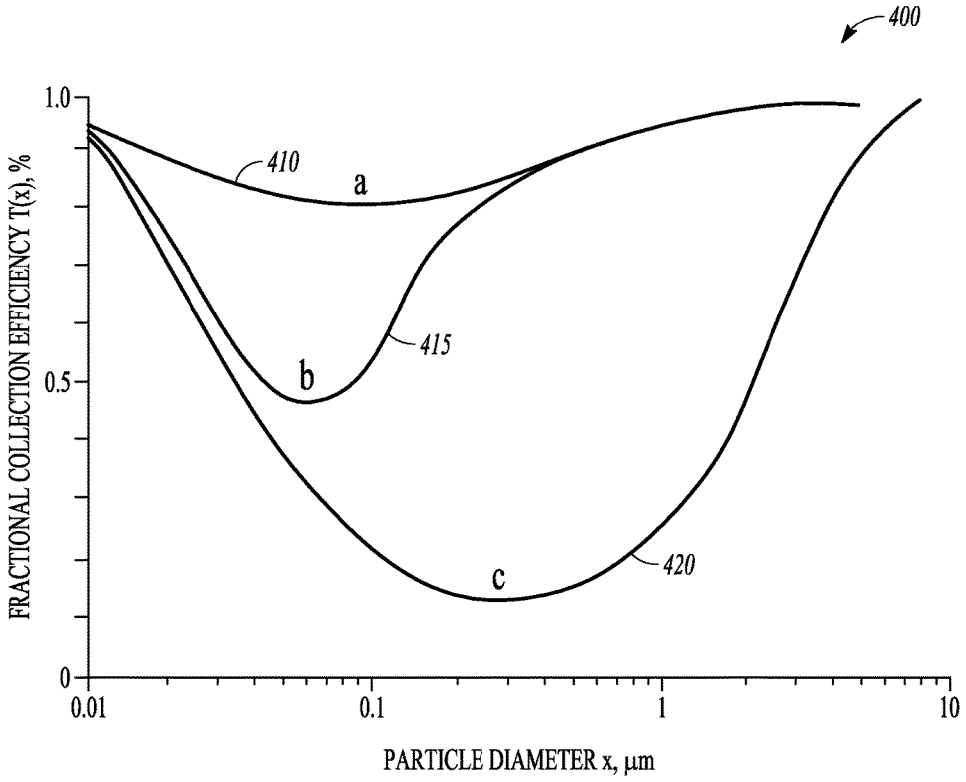
FIG. 4 is a graph illustrating filter fractional collection efficiency for varying particle diameters according to an example embodiment.

FIG. 4 is an example graph 400 of fractional collection efficiency versus particle diameter in μm. Graph 400 illustrates that pre-charged particles are captured efficiently independent of size. Three curves are shown for an electret filter spun from a polymer solution. At 410, the filter fibers and particles are charged. At 415, the fibers are charged, but the particles are uncharged. At 420, the fibers and particles are uncharged. A superficial particle velocity of 0.1 m/s was used to generate the curves. The curve 410 corresponding to both fibers and particles being charged showed the highest fractional collection efficiency.

EXAMPLES

1. A method comprising:
ionizing particles to be captured;
creating electric fields to polarize mats of filter material; and
trapping the ionized particles in the polarized mats.

2. The method of example 1 wherein mats are formed of conducting fibers.

3. The method of example 2 wherein conducting fibers to be positively charged have a diameter smaller than a diameter of conducting fibers to be negatively charged such that a higher charge density is formed on the positively charged fibers when creating the electric fields.

4. The method of any of examples 2-3 wherein the conducting fibers are woven.

5. The method of any of examples 2-4 wherein the fibers have a diameter of 1-5 microns.

6. The method of any of examples 1-5 wherein ionizing particles comprises generating many very small droplets of water.

7. The method of example 6 wherein the droplets of water are created by a micro nozzle spraying humidifier placed upstream from the mats of filter material 8. The method of example 7 wherein the humidifier is placed within a distance of 1-2 feet of the mats of filter material.

9. The method of any of examples 1-8 wherein nonconducting layers between closely spaced conducting layers are polarized by the electric fields.

10. The method of any of examples 1-9 and further comprising measuring a capacitance across the mats of filter material.

11. The method of example 10 and further comprising determining an end of filter life as a function of the measured capacitance.

12. The method of any of examples 1-11 wherein the voltage comprises an AC voltage to cause particles to move in both directions through a mat of filter material.

13. A filter comprising:
multiple mats of conducting filter material;
multiple mats of non-conducting filter material, each non-conducting filter material mat disposed between adjacent mats of conducting material; and
electrodes coupled to the mats of conducting filter material to create an electric field between successive mats of conducting material to enhance filtering of ionized particles in fluid flowing through the filter.

14. The filter of example 13 wherein the mats of conducting filter material are formed of conducting fibers.

15. The filter of example 14 wherein the conducting fibers are woven.

16. The filter of any of examples 14-15 wherein the fibers have a diameter of 1-5 microns.

17. The filter of any of examples 13-16 wherein the mats of conducting and non conducting filter material are formed of isolating fibers with both sides of the mat coated with a conductive material.

18. The filter of any of examples 13-17 and further comprising metal grids outer sides of the mats.

19. The filter of any of examples 13-18 and further comprising a micro nozzle spraying humidifier positioned upstream from the mats of filter material.

20. The filter of example 19 wherein the humidifier is positioned within a distance of 1-2 feet of the mats of filter material.

Although a few embodiments have been described in detail above, other modifications are possible. For example, the logic flows depicted in the figures do not require the particular order shown, or sequential order, to achieve desirable results. Other steps may be provided, or steps may be eliminated, from the described flows, and other components may be added to, or removed from, the described systems. Other embodiments may be within the scope of the following claims.

The invention claimed is:

1. A method comprising:
ionizing particles to be captured;
creating electric fields to polarize mats of filter material formed of conducting fibers and mats formed of non-conducting filter material disposed between adjacent mats of conducting fibers; and
trapping the ionized particles in the polarized mats.

2. The method of claim 1 wherein creating electric fields comprises positively and negatively charging different conducting fibers wherein positively charged conducting fibers have a diameter smaller than a diameter of negatively charged conducting fibers such that a higher charge density is formed on the positively charged fibers when creating the electric fields.

3. The method of claim 1 wherein the conducting fibers are woven.

4. The method of claim 1 wherein the fibers have a diameter of 1-5 microns.

5. A method comprising:
ionizing particles to be captured, wherein ionizing particles comprises generating many very small droplets of water;
creating electric fields to polarize mats of filter material; and
trapping the ionized particles in the polarized mats.

6. The method of claim 1 wherein nonconducting layers between closely spaced conducting layers are polarized by the electric fields.

7. A method comprising:
ionizing particles to be captured;
creating electric fields to polarize mats of filter material;
trapping the ionized particles in the polarized mats; and
measuring a capacitance across the mats of filter material.

8. The method of claim 7 and further comprising determining an end of filter life as a function of the measured capacitance.

9. The method of claim 1 wherein the electric fields are created by an applied AC voltage to cause particles to move back and forth through a mat of filter material.

10. A filter comprising:

multiple mats of conducting filter material formed of conducting fibers;

multiple mats of non-conducting filter material, each non-conducting filter material mat disposed between adjacent mats of conducting material; and electrodes coupled to the mats of conducting filter material to create an electric field between successive adjacent mats of conducting material to enhance filtering of ionized particles in fluid flowing through the filter.

11. The filter of claim 10 wherein the conducting fibers are woven.

12. The filter of claim 10 wherein the fibers have a diameter of 1-5 microns.

13. The filter of claim 10 and further comprising metal grids outer sides of the mats.

* * * * *